United States Patent [19]

Schiemichen et al.

[11] 4,318,640

[45] Mar. 9, 1982

[54] LIFTING ISLAND

[75] Inventors: Peter Schiemichen, Hünxe; Werner Zimmerman, Langenfeld, both of Fed. Rep. of Germany

[73] Assignee: Deutsche Babcock Aktiengesellschaft, Oberhausen, Fed. Rep. of Germany

[21] Appl. No.: 75,178

[22] Filed: Sep. 12, 1979

[30] Foreign Application Priority Data

Sep. 29, 1978 [DE] Fed. Rep. of Germany ..... 2842499

[51] Int. Cl.[3] ..... E02B 17/02

[52] U.S. Cl. ..... 405/199; 254/106

[58] Field of Search ..... 405/196–199, 405/202; 254/106, 89 R, 95

[56] References Cited

U.S. PATENT DOCUMENTS 2,873,580 2/1951 Suderow ..... 405/199

3,435,621 4/1961 Johnson ..... 254/106

3,517,910 6/1970 Sutton et al. ..... 254/106

3,844,002 10/1974 Slemmon ..... 405/199

*Primary Examiner*—William F. Pate, III

*Attorney, Agent, or Firm*—Max Fogiel

[57] ABSTRACT

An off-shore platform of the self-erecting type has a floating deck provided with legs which can be raised and lowered and on which the platform is jacked up after they rest on a base structure placed onto the ocean floor. Each of the legs is guided within the deck in two vertically spaced bearings, the upper one of which is universally yieldable so that the leg can pivot about a center point of this bearing and the lower one of which is yieldable only in radial direction and provided with an annular space surrounding the leg and into which compressible or incompressible flowable medium can be introduced at will so as to allow the bearing either to yield or else to prevent it from yielding.

9 Claims, 4 Drawing Figures

LIFTING ISLAND

BACKGROUND OF THE INVENTION

The invention relates to a lifting island the platform of which is provided with supporting legs that can be raised and lowered and which are supported on a base construction placed onto the sea bottom.

Such lifting islands are water vessels which are used for certain types of sea constructions or for off-shore drilling. To secure the working position the supporting legs of the platform are lowered to the base construction that has previously been placed onto the sea bottom and then the platform is lifted out of the water along the firmly seated supporting legs until the requisite height above the water level is reached. The seating of the supporting legs on the base construction is always a critical operation. The platform which swings up and down with the waves may, under unfavorable sea conditions, repeatedly abut with the extended supporting legs against the base construction, before it is finally fixed. This may lead to considerable damage to the base construction and to the supporting legs.

To prevent this a proposal which does not belong to the state of the art has suggested that the lower end of each supporting leg have attached to it a shock absorber in form of a ring which is resiliently supported on the supporting leg. This ring surrounds the contact surface of the supporting leg on the base construction and extends beyond it in axial direction. However, this construction absorbs essentially only forces acting in vertical direction. Under unfavorable sea conditions impacts act upon the supporting legs in the horizontal direction also, and these cannot be absorbed by the aforementioned shock absorbers alone.

SUMMARY OF THE INVENTION

The purpose of the invention is to so further construct a lifting island of the type mentioned in the introduction, that even blows acting laterally upon the supporting legs can be absorbed, but that on the other hand a reliable guidance of the supporting legs within the platform is not disadvantageously influenced.

According to the invention this problem is solved in that each supporting leg is guided in two yieldable bearings spaced vertically from one another, that one of the bearings yields in all directions about a center point and that the other bearing yields only radially and that the radial yielding of the other bearing can be adjusted up to the point of non-yieldability. Thanks to this support, each supporting leg can tilt about a turning point. The movements resulting during this tilting are absorbed by the bearing which yields only in radial direction. The yieldability of this bearing is terminated by adjustment, when the supporting legs are firmly seated on the base construction and the platform is slowly raised along the supporting legs. In this case a fixed guidance between the supporting legs and the platform is achieved. Thus, the radially yieldable bearing acts like a centering arrangement.

The universally yieldably constructed bearing may be composed of bearing halves which are yieldably supported. In order, however, to more reliably absorb the impacts, a further embodiment of the invention proposes that this bearing is composed of individual segments which are circumferentially spaced, are composed of an elastically deformable material and connected at one side with the platform.

In an advantageous embodiment of the invention the radially yieldable bearing has walls of a yieldable material which surround an inner space that can be filled selectively with a compressible or an imcompressible flowable medium. The inner space is filled with air prior to the setting-down of the supporting legs, so that the walls of the bearing can yield. After the setting-down of the supporting legs, the air in the inner space is replaced with water. This results in a tight guidance of the supporting legs during the lifting of the platform.

An exemplary embodiment of the invention is illustrated in the drawing and will hereafter be described in more detail.

DESCRIPTION OF PREFERRED EMBODIMENTS

Figure 1:
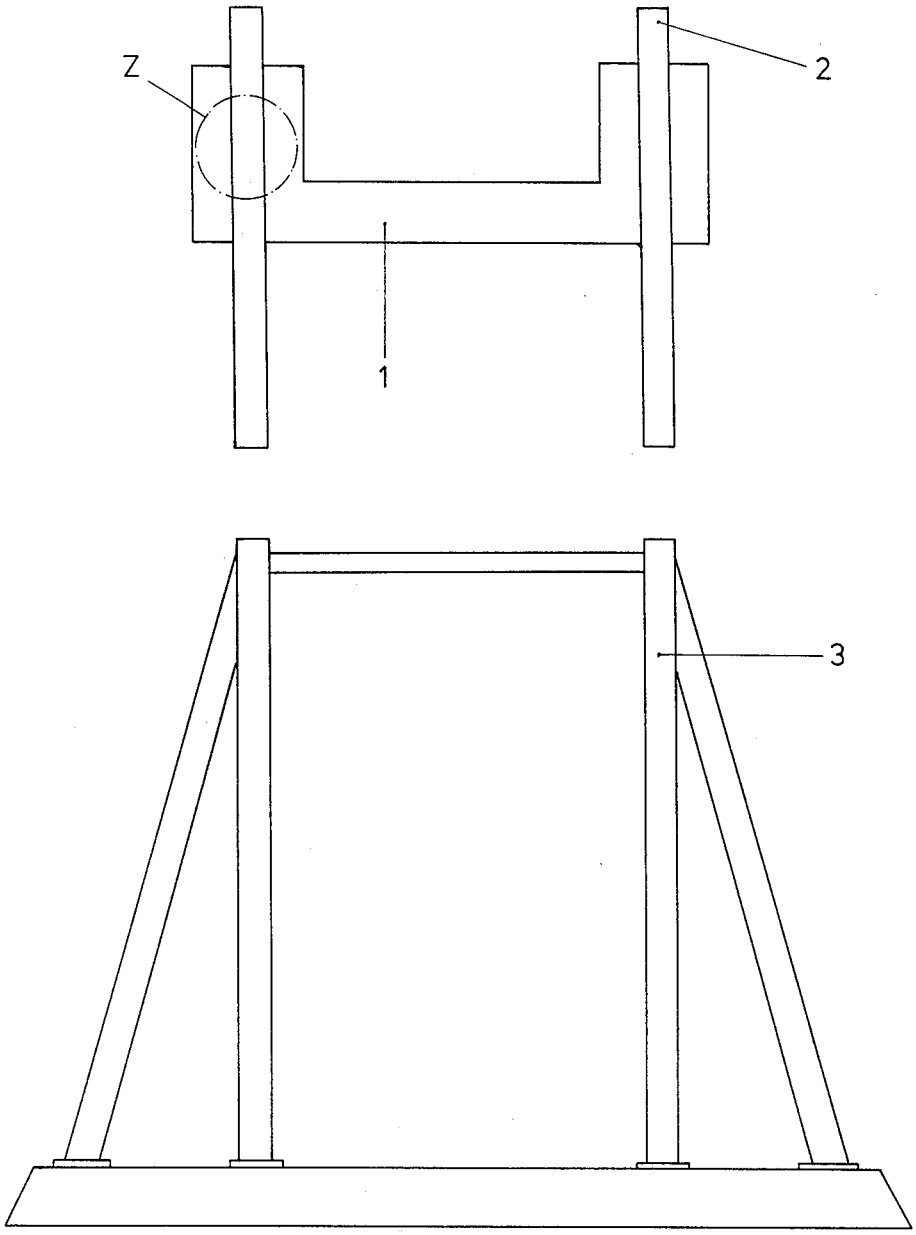
FIG. 1 illustrates a lifting island.

The illustrated lifting island is composed of the platform 1 and the raisable and lowerable supporting legs 2. The supporting legs 2 are supported, in the working position of the platform 1, on a base construction 3 which has previously been lowered and rests upon the sea bottom.

The platform 1 is self-floating and is towed by ocean-going tugs to the intended erection site. During the positioning of the platform 1 above the base construction 3 and during the lowering of the supporting legs 2 the platform 1 floats on the surface of the sea and is raised and lowered again to a greater or lesser degree, depending upon the height of the waves.

The hydraulic drive for lowering of the supporting legs 2 and the later lifting of the platform 1 is composed of several cylinders 4 which are uniformly spaced about each supporting leg 2. The cylinders 4 are connected with one of the lower beams of the platform 1. They are so supported that they can pivot about two mutually normal horizontal axes. The piston rods of the cylinders 4 are articulately connected to a ring 5. The ring 5 can be clamped to the supporting leg 2 via a hydraulically operable lever arrangement 6. Below the ring 5, a further ring 7 is provided which can also be clamped to the supporting leg 2.

Figure 2:
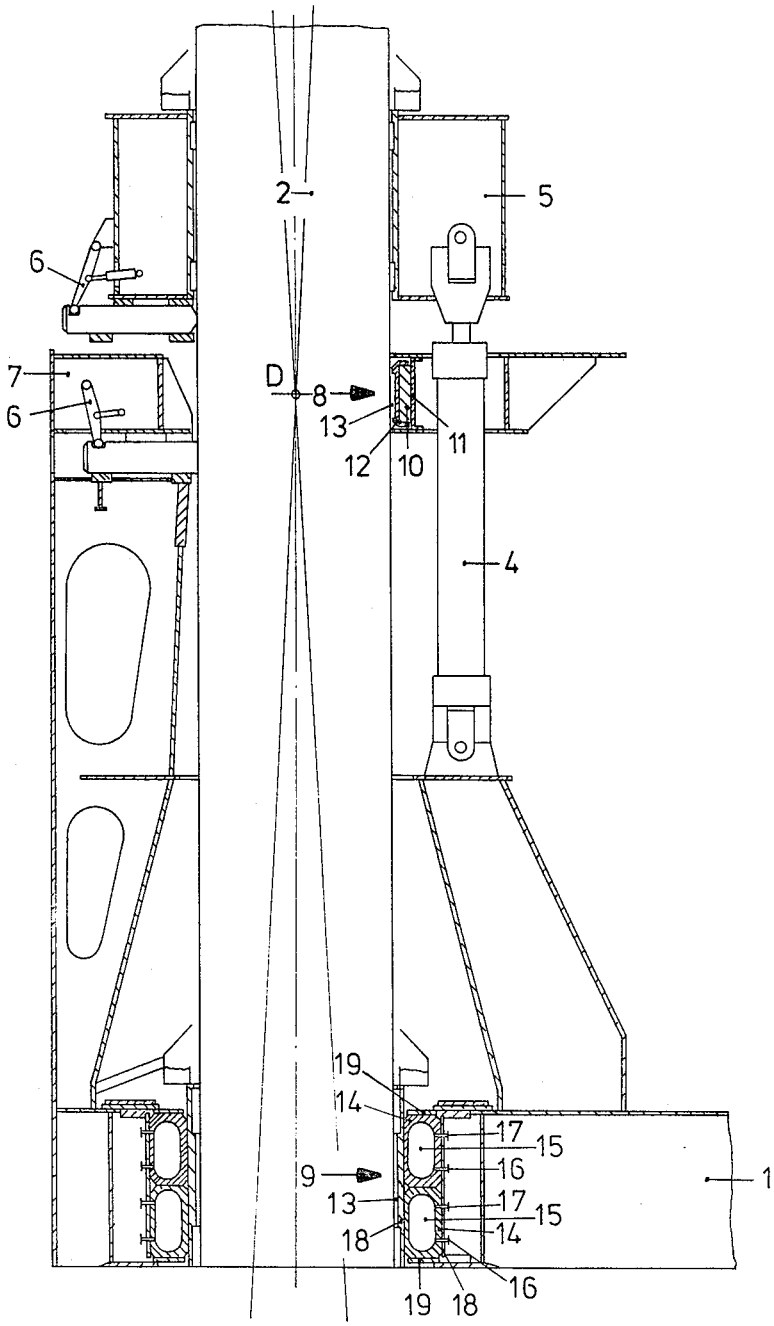
FIG. 2 illustrates the detail Z of FIG. 1.

When the contact surfaces of the supporting legs 2 rest on the corresponding counterparts of the base construction 3, the piston rods of the cylinders 4 are retracted with the ring 5 in clamped position, whereby the platform 1 are raised relative to the supporting legs 2. When the position of the cylinders 4 is reached which is illustrated in FIG. 2, then the platform 1 is clamped to the supporting leg 2 via the ring 7. After releasing the clamping of the ring 5 the piston rods of the cylinders 4 are extended. Thereafter, the extension and retraction of the piston rods of the cylinders 4 and the alternate clamping of the rings 5 and 7 is repeated, until the platform has reached the desired position above the surface of the sea.

During the lowering of the supporting legs 2 with the platform 1 in floating condition, the wave motion acting upon the platform 1 causes uncontrollable impacts to act upon the supporting legs in horizontal direction. These impacts may cause damage to the guidance of the supporting legs 2 within the platform 1. To be able to absorb these impacts each supporting leg 2 is guided in two yieldably constructed bearings 8 and 9. The bearing 8 arranged in the upper part of the platform 1 is universally yieldably constructed. In this manner, the supporting leg 2 guided in the bearing 8 can perform swinging movements about the pivot point D which corresponds to the center point of the bearing 8. The bearing 8 is composed of individual segments 10 which are arranged circumferentially spaced about the supporting leg 2. The segments 10 are composed of an elastically deformable material, e.g. of rubber. On their rearward side, the segments 10 are connected with a steel plate 11, e.g. by bonding. The steel plate 11 is secured to the platform 1. On the side facing the supporting leg 2 the segments 10 are surrounded by a bushing 12. Inserted into the bushing 12 is a glide surface 13 which contacts the supporting leg 2. The glide surface 13 has a low coefficient of friction.

The bearing 9 arranged in the lower part of the platform 1 can yield only in radial direction. The bearing 9 is formed by two circumferentially closed rings located above one another and the walls 14 of which are of a yieldable material, e.g. rubber. The walls 14 surround an internal space 15 which selectively is filled with an incompressible medium such as water or a compressible medium such as air. The introduction and removal of water is effected through a lower nipple 16 and the introduction and removal of the air through an upper nipple 17 which extend through the rear wall 14 of the bearing 9. The walls of the bearing 9 are reinforced by plates 18 and 19 which are placed on them. The width of the plate 19 is smaller than the width of the bearing 9. Inserted into the plate 18 which faces the supporting leg 2 is a glide surface 13 of a low coefficient of friction.

During the lowering of the supporting legs 2, the inner space 15 of the bearing 9 is filled with air. Thanks to the compressibility of the air the bearing 9 can elastically yieldable in radial direction. When the supporting legs 2 are seated on the base construction 3 and the platform 2 is to be raised, then the air 19 is completely expelled from the inner space 15 by water. In this case the bearing 9 is completely unyieldable and acts like a centering device. In this manner a firm guidance of the supporting legs 2 is obtained.

Figure 3:
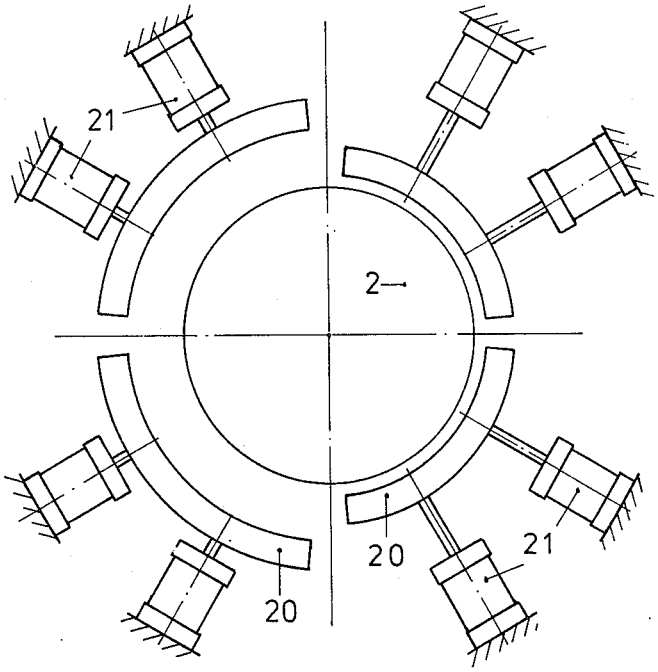
FIG. 3 illustrates a top-plan view of another embodiment of the invention.
Figure 4:
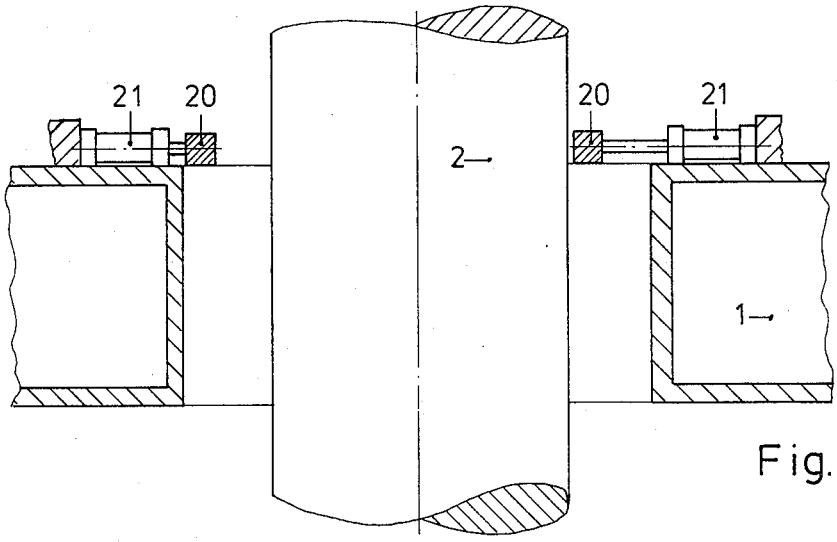
FIG. 4 illustrates the therewith associated longitudinal section.

In the embodiment according to FIGS. 3 and 4 the lower radially yieldable bearing is replaced by a centering device which is composed of several, in the present instance four, bushings 20 which are distributed about the circumference of the supporting legs 2. Each bushing 20 is supported on the piston rods of two setting cylinders 21. The setting cylinders 21 act in radial direction and are horizontally mounted on the platform 1. The setting cylinders 21 which are shown in FIGS. 3 and 4 in their respective end positions, can yield to movements of the supporting legs 2 in radial direction through approximately 600 millimeters.

The cylinders basis of two diametrically opposite setting cylinders 21 or a setting cylinder groups are always connected via a connecting conduit, in which a throttling and blocking valve is arranged. During a tilting of the supporting leg 2 the pressure medium which escapes from the setting cylinder 21 on the respective side, travels via this connecting conduit into the setting cylinders 21 on the opposite side of the supporting leg 2. The throttle valve located in the connecting conduit provides for a damping of the tilting movement.

When the supporting legs 2 rest on the base construction 3, then the blocking valve in the connecting conduit is closed. The piston of that setting cylinder 21 the bushings 20 of which have moved farthest outwardly, are subjected to the action of pressure medium. At the same time, the excess pressure medium is discharged into a storage container from the piston spaces of the setting cylinders at the opposite side of the supporting leg 2. When the supporting leg 2 has reached its vertical position, all valves for the supply and removal of pressure medium are blocked. All setting cylinders 21 are then uniformly subjected to pressure, so that a yieldable movement of the lower bearing for the supporting leg is now impossible. In place of the described hydraulic control the setting cylinders can also be so connected that they operate against a pressure reservoir.

We claim:

1. An off-shore platform, comprising a deck; a plurality of upright legs; means mounting said legs in said deck for relative movement of the deck and legs in upright direction, said means comprising for each of said legs two vertically spaced support bearings one of which is universally yieldable about a center point thereof and the other of which is yieldable only in radial direction; and means for varying the ability of said other bearing to yield in radial direction between a maximum and a minimum value; said bearings providing continuous guidance of the legs during relative motion between them and the deck; said other bearing serving to center the respective leg and comprising a plurality of fluid-operated cylinder-and-piston units mounted on said deck angularly spaced about the respective leg and each having a piston rod extending radially of the leg, and a plurality of bearing members each carried by one of said piston rod and together encircling the respective leg.

2. A platform as defined in claim 1, wherein said minimum value is equal to zero.

3. A platform as defined in claim 1, said radially yieldable bearing comprising deformable wall means bounding and defining a space surrounding the respective leg; and wherein said varying means comprises means for selectively admitting a compressible flowable medium into said space.

4. A platform as defined in claim 1, said radially yieldable bearing comprising deformable wall means bounding and defining a space surrounding the respective leg; and wherein said varying means comprises means for selectively admitting an incompressible flowable medium into said space.

5. A platform as defined in claim 1, said cylinder-and-piston units being arranged in pairs and the units of each pair being located diametrically opposite one another.

6. A platform as defined in claim 5, said units each having cylinder chambers adapted to accommodate pressure fluid; and further comprising conduit means connecting the cylinder chambers of the units of each pair, and flow-controlling means interposed in said conduit means.

7. A platform as defined in claim 6, said flow-controlling means comprising a throttling and blocking valve in each of said conduit means.

8. An off-shore platform, comprising a deck; a plurality of upright legs; means mounting said legs in said deck for relative movement of the deck and legs in upright direction, said means comprising for each of said legs two vertically spaced support bearings one of which is universally yieldable about a center point thereof and the other of which is yieldable only in radial direction; and means for varying the ability of said other bearing to yield in radial direction between a maximum and a minimum value, said one bearing comprising an annulus of circumferentially spaced segments of elastically deformable material connected to said deck.

9. An off-shore platform, comprising a deck; a plurality of upright legs; means mounting said legs in said deck for relative movement of the deck and legs in upright direction, said means comprising for each of said legs two vertically spaced support bearings one of which is universally yieldable about a center point thereof and the other of which is yieldable only in radial direction; and means for varying the ability of said other bearing to yield in radial direction between a maximum and a minimum value, said bearings each having a surface facing the respective leg and provided with a layer of material having a low coefficient of friction.

* * * * *